US005580138A

United States Patent [19]

Grabher

[11] Patent Number: 5,580,138

[45] Date of Patent: Dec. 3, 1996

[54] RETRACTION-ASSISTING DEVICE FOR USE WITH A DRAWER

[75] Inventor: Karl-Heinz Grabher, Lustenau, Austria

[73] Assignee: Alfit Aktiengesellschaft, Götzis, Austria

[21] Appl. No.: 520,655

[22] Filed: Aug. 29, 1995

[30] Foreign Application Priority Data

Aug. 31, 1994 [AT] Austria ..... 1666/94

[51] Int. Cl.[6] ..... A47B 88/00

[52] U.S. Cl. ..... 312/319.1; 312/333

[58] Field of Search ..... 312/319.1, 331, 312/334.1, 333, 334.44

[56] References Cited

U.S. PATENT DOCUMENTS

| | | | |
|---|---|---|---|
| 3,674,329 | 7/1972 | Schill | 312/319.1 |
| 5,135,294 | 8/1992 | Ohshimo et al. | 312/319.1 |
| 5,207,781 | 5/1993 | Rolk | 312/319.1 |

FOREIGN PATENT DOCUMENTS

| | | | |
|---|---|---|---|
| 386731 | 9/1990 | European Pat. Off. . | |
| 391221 | 10/1990 | European Pat. Off. . | |
| 4124512 | 2/1992 | Germany . | |
| 0056372 | 5/1912 | Switzerland | 312/319.1 |
| 92/04843 | 4/1992 | WIPO . | |

*Primary Examiner*—Peter M. Cuomo
*Assistant Examiner*—Gerald A. Anderson
*Attorney, Agent, or Firm*—Collard & Roe, P.C.

[57] ABSTRACT

A retraction-assisting device for a drawer, comprises two guide housings, fixed to respective ones of corpus rails and each of which and comprises laterally spaced apart first and second longitudinally extending guide flanges, connecting member extends between the guide flanges and has comprises on one side a an indentation adapted to receive a coupling element on the drawer. The connecting member assumes a drawer-coupling first angular position, in which it is movable toward a forward end of the housing to stress the spring and a drawer-releasing second angular position, in which the coupling element is disengageable from to release the drawer and is also adapted to re-engage the indentation to return to the first angular position so that said drawer is then coupled to the connecting member, whereafter the stressed spring urges the connecting member toward the rear end of the guide housing.

8 Claims, 2 Drawing Sheets

RETRACTION-ASSISTING DEVICE FOR USE WITH A DRAWER

BACKGROUND OF THE INVENTION

1. Field of the Invention

This invention relates to a retraction-assisting device for retracting or for assisting the retraction of a drawer, which comprises two side walls and is in guiding contact with respective drawer-guiding corpus rails and carries respective coupling elements. Said retraction-assisting device comprises two guide housings, which are adapted to be fixed to respective ones of said corpus rails and each of which has forward and rear ends and contains a tension spring, which is fixed to said guide housing at said rear end thereof. A connecting member is pivoted to said tension spring at its forward end and comprises on one side a coupling portion, which laterally protrudes from said guide housing and has outside said guide housing an indentation adapted to receive one of said coupling elements. Said connecting member is slidably mounted in said guide housing, which comprises a trough that is defined by first and second guide flanges, which constitute linear guides for said connecting member. The connecting member is adapted to assume in said guide housing a drawer-coupling first angular position, in which said connecting member with said coupling element engaged in said indentation is movable toward said forward end of said guide housing to stress said tension spring. Said connecting member is arranged to assume under the stress of said spring adjacent to said forward end of said guide housing a drawer-releasing second angular position, in which said coupling element is disengageable from said coupling portion and adapted to re-engage said coupling portion in said indentation and to urge said coupling portion to said first angular position, whereafter said stressed tension spring is adapted to urge said connecting member with said coupling element engaging said coupling portion in said indentation toward said rear end of said guide housing.

2. Description of the Prior Art

Such a retracting or retraction-assisting device is basically known from WO 92/04843 A. That device is used to ensure that the drawer when it has been pushed in to a certain position will then automatically be urged to its fully retracted position and will be held in said retracted position by the springs, which have been tensioned during the extraction of the drawer.

In that known retraction-assisting device the linear guides merge into a widened portion adjacent to the forward end of the guide housing and said widened portion constitutes a slotted-cam guide for cooperating with the connecting member, which consists of a sliding member, to which the tension spring is laterally connected at its center. The coupling element has a rounded forward end, which is adapted to engage said guide housing in said slotted-cam guide, which first extends outwardly in an oblique direction and then merges into a straight portion, which is parallel to the linear guide, and is terminated by a stop wall. The connecting element has a beveled rear end portion, and for engagement with said rear end portion the linear guide has an outwardly directed arcuate portion, which is succeeded by a linear guiding portion. Between the arcuate portion and the linear guiding portion the slotted-cam guide comprises a corner-shaped portion, which constitutes a detent stop for said beveled end portion of the connecting member. As the drawer is extracted, the connecting member is tilted to assume an inclined position between the two linear portions of the slotted-cam guide whereas the beveled rear surface of the connecting member engages said arcuate portion.

The known design has the disadvantage that the guide housing is expensive because it must be wide enough to accommodate the slotted-cam guide so that the installation is difficult and the overall function is not exactly defined. There may be no proper interlock at the end of the extracting movement and in that case the connecting member may be pulled back to its initial position by the spring when the connecting member has released the drawer so that the retraction-assisting device will then be ineffective. Alternatively, the closing of the drawer may cause the coupling element to engage the connecting member and considerable pressure will then have to be exerted via the coupling element in order to effect a disengagement so that the connecting member will finally be disengaged with a loud noise. In view of the malfunction which is possible, the coupling portion comprises a catching device, and when the connecting member has not properly been coupled to the coupling element that catching device may be used to couple the connecting member once more to the coupling element when the drawer has been entirely retracted so that the drawer can subsequently be extracted.

EP-B 0 386 731 discloses a retraction-assisting device which comprises inside the guide housing a slotted-cam guide for guiding the connecting member. That slotted-cam guide comprises at its rear end a stop for engaging a guide pin of the connecting member and at the forward end has a curved portion, by which the connecting element is guided at the forward end of the guide housing to the second angular position, in which the coupling element is disengageable from the coupling portion. Whereas that design is reliable in operation, its overall expenditure is very high and its overall volume is rather large so that it is difficult to accommodate the device at the corpus rails. Another disadvantage of that retraction-assisting device resides in that the device cannot be mounted with the guide housing on the inside surface of the corpus rail so that the position of the coupling element relative to the indentation of the coupling portion may depend on the load on the drawer and there is a risk that the coupling member may not engage the coupling portion in the indentation as the drawer is inserted. It has been attempted to improve that design so as to decrease the overall volume and to provide an arrangement which permits the housing to be mounted on the underside of a corpus rail and to simplify the overall design by the provision of a trough-shaped housing, which is open toward the corpus rail. A EP-A 391 221 discloses a retraction-assisting device in which the connecting member is guided by means of two pins in a guide groove of the guide housing. In that case too the guide groove merges at its forward end into an arcuate guide for guiding the coupling portion to its angular position for extracting the drawer.

DE-A 41 24 512 represents an effort to provide a guide housing having a simpler linear guide. To that end, only a slider, which is connected to the spring, is mounted in the troughlike guide housing, and the indentation for locking the coupling element is formed in a segment which is pivoted to that slider. That segment comprises a feeler, which bears on a separate guide web, by which the segment is released at the forward end of the guide housing so that the coupling element can then leave the indentation. In that case too the composite assembly involves a high expenditure. The pivoting of the tiltable segment to the slider is not reliable in operation, and the overall volume is so large that the installation may be difficult.

SUMMARY OF THE INVENTION

It is an object of the invention to provide a retraction-assisting device which is of the kind described first hereinbefore and is simple in design and can easily be mounted, has a small overall volume and nevertheless is highly reliable in operation and will generate only a low noise in operation.

In a retraction-assisting device of the kind described first hereinbefore that object is accomplished in that the said first guide flange extends continuously substantially from said rear end to said forward end of said guide housing, said connecting member is provided on that side which is opposite to the coupling portion with a detent projection, which may have the shape of a hook, and said forward end of said guide housing a detent receptacle for receiving said detent projection to permit said connecting member to assume said second angular position for releasing said coupling element.

The guide housing has only simple linear guides. Nevertheless the connecting member may be simple and consist of only one piece. The overall height is small, and the parts can easily be assembled and mounted. The guide housing is so mounted that the trough is open to the corpus rail so that the essential parts of the retraction-assisting device and particularly the guides will be protected from being soiled. The invention is essentially based on the recognition that the detent projection and the receptacle can be so designed that the need for the previously used slotted-cam guides is eliminated although the connecting member consists of only one piece and is coupled to the spring and is adapted to lock itself in both angular positions. The device is highly reliable in operation and will generate only a very low noise in operation.

A preferred feature of the invention resides in that when the connecting member is in its first angular position its detend projection is in sliding contact with the second guide flange to guide the connecting member, the connecting member has a guiding surface, which is in sliding contact with said first guide flange when said connecting member is in said first angular position, and the connecting member has on the same side as said detent projection a guiding surface which engages said second guide flange when said connecting element is in said second angular position. In that case each of said first and second angular positions will exactly be defined so that a satisfactory operation will be ensured. The pinlike coupling element engaging said coupling portion in said indentation will cause a tilting moment to be exerted on the connecting member also during the extraction of the drawer and will thus tilt the connecting member to its second angular position as the detent projection reaches the detent receptacle.

According to a further feature of the invention the detent projection may be forwardly spaced from the coupling portion and the indentation therein. That feature will have the result that during the movement of the connecting member from its first to its second angular position the movement performed by the detent projection will be larger than the movement imparted by the coupling element to the coupling portion in the indentation because the connecting member consists of a one-armed lever, which at its rear end is pivoted to the spring, and the coupling element then engages the connecting member at the forward end of only a rear part of said lever whereas the detent projection is provided at the forward end of said lever.

DETAILED DESCRIPTION OF THE PREFERRED EMBODIMENT

Figure 1:
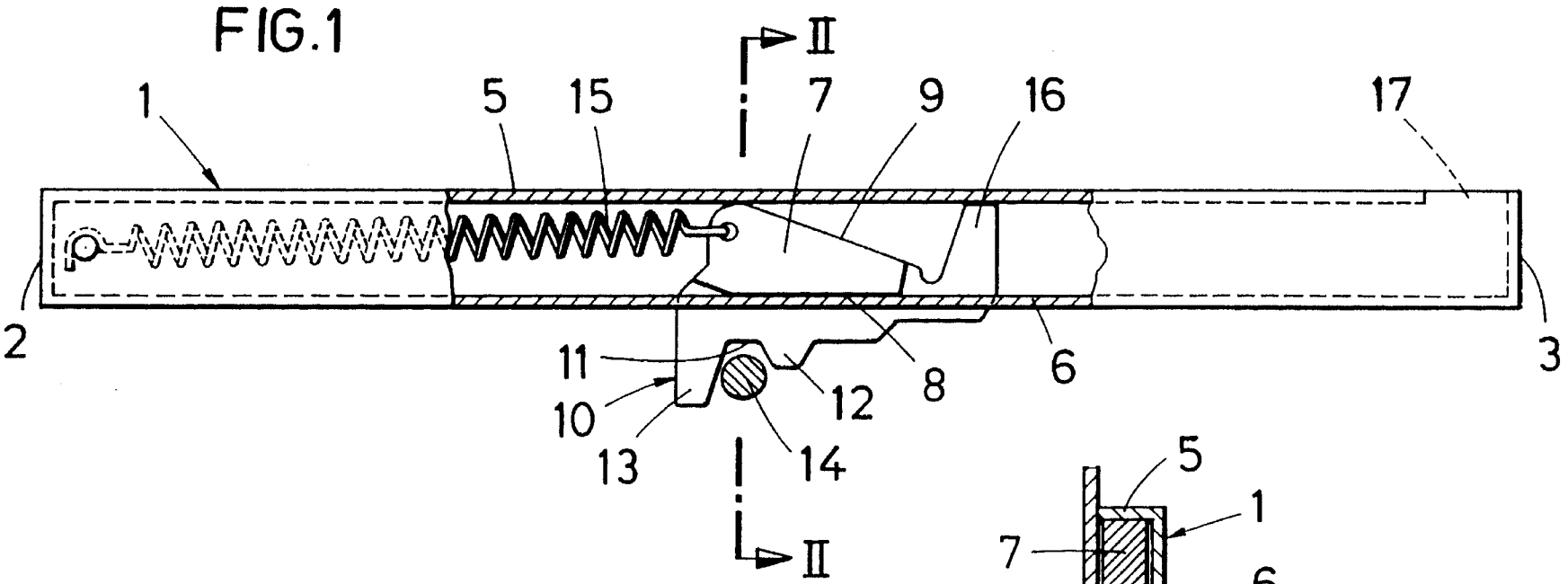
FIG. 1 is a partly schematic side elevation showing a retraction-assisting device embodying the invention in its retracted position and with the guide housing shown partly in section.

An illustrative embodiment of the invention will now be described more in detail with reference to the drawing.

Figure 4:
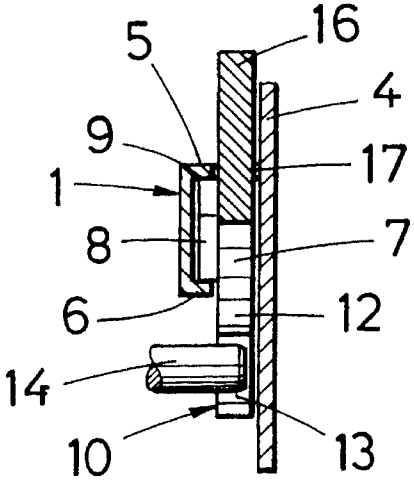
FIG. 4 is a sectional view taken in line IV—IV in FIG. 3.

The illustrated retraction-assisting device comprises for use adjacent to each side wall of a drawer a guide housing 1, which comprises a trough, which has opposite first and second side flanges 5 and 6, which in the illustrative embodiment differ in width. The guide housing is closed by a rear end wall 2 and a forward end wall 3, which together with the flanges 5 and 6 define an opening, which faces a corpus rail 4, which is indicated only in FIG. 2 and 4. The second flange 6 of the guide housing is secured to the inwardly facing surface of said corpus rail, as illustrated, or to its underside surface. The guide housing 1 extends along the corpus rail only over a part of the length of the corpus rail. The narrower first or bottom flange 6 and the wider second or top flange 5 of the housing 1 have confronting inside surfaces, which constitute linear guides for guiding a connecting member 7, which has bottom and top guiding surfaces 8 and 9 for engaging said bottom and top flanges 6 and 5 in alternation. The connecting member 7 comprises on one side a coupling portion 10, which beyond the narrower bottom flange 6 protrudes laterally out of the housing 1 and is formed outside the housing 1 with an indentation 11, which is defined on its forward side by a relatively short nose 12 and on its rear side by a relatively long nose 13. The retraction-assisting device serves to retract or to assist the retraction of a drawer, which is not shown and which is provided with two laterally spaced apart coupling pins 14, which may be mounted on the drawer as it is manufactured or may be fixed to an existing drawer. In the position shown in FIGS. 1 and 2 each of said coupling pins 14 engages one of the coupling portions 10 in its indentation 11. The housing 1 contains a tension spring 15, which at its rear end is secured to the rear end wall 2 of the housing 1. The connecting member 7 is pivoted to the forward end of the tension spring 15, which will be stressed by means of the pin 14 and the connecting member 7 as the drawer is extracted.

Figure 2:
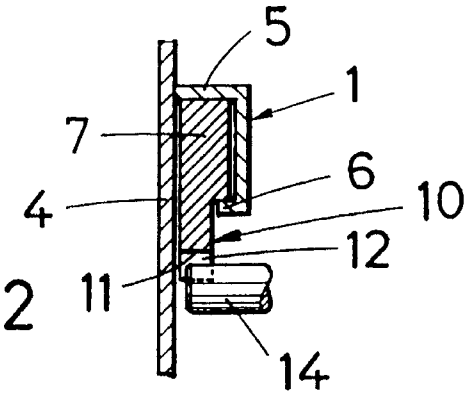
FIG. 2 is a sectional view taken on line II—II in FIG. 1.

On its top side facing the top flange 5, the connecting member 7 carries a hook-shaped detent projection 16, which is spaced along the guide housing 1 from the indentation 11 and has a top end face, which in the position shown in FIG. 1 engages the inside surface of the top flange 6 so that the connecting member 7 is then guided by the top flange 5 at the top end of the detent projection 16 and at a rounded top surface portion at the rear of the surface 9 whereas the bottom guiding surface 8 of the connecting member 7 is in sliding contact with the inside surface of the bottom flange 6.

Figure 3:
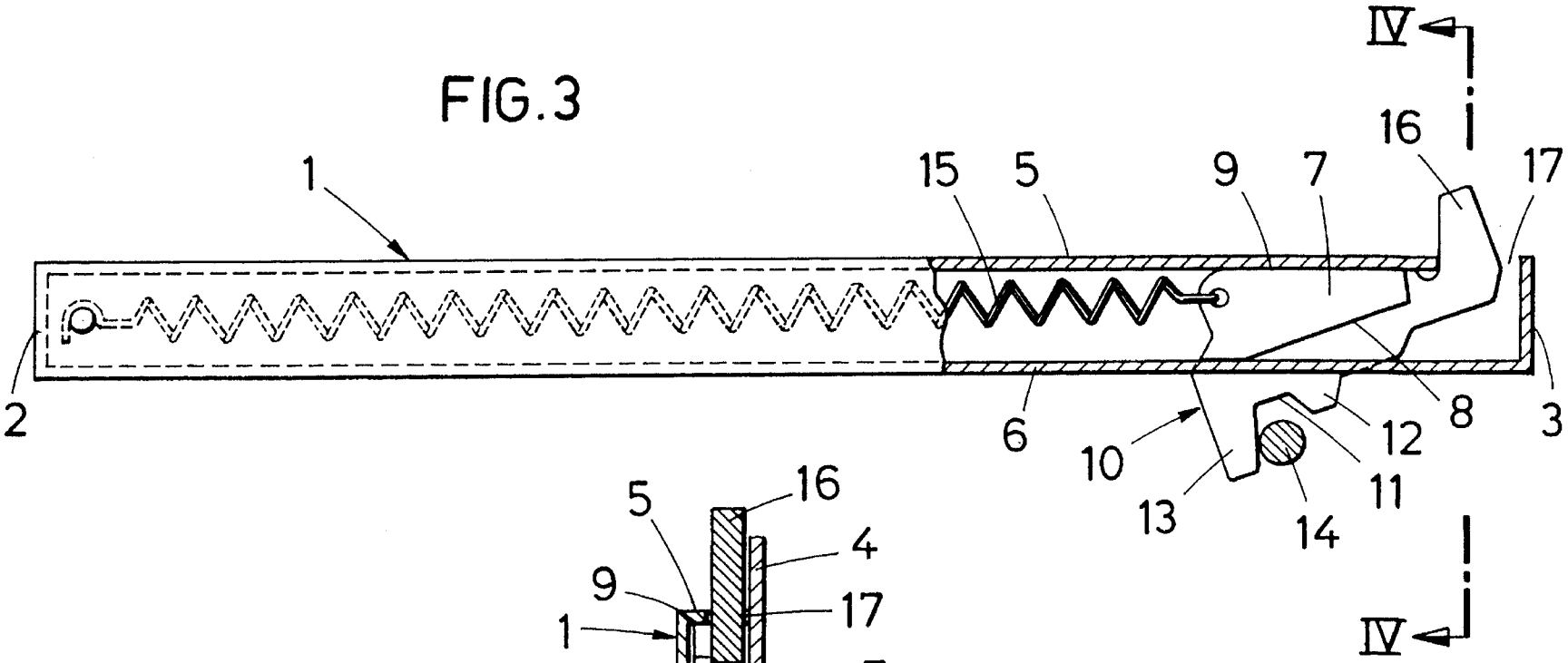
FIG. 3 is a view that is similar to FIG. 1 and shows the retraction-assisting device in its most forward position.

The forward movement of the retraction-assisting device is limited by a detent receptacle, which is constituted by an opening 17 in the top flange 5 adjacent to the forward end wall 3 of the housing 1 and is arranged to receive the detent hook 16 in the position illustrated in FIG. 3. During the extraction of the drawer the pin 14 bears on the nose 12 to exert on the coupling portion 17 a tilting moment, by which the hook 16 is normally urged against the inside surface of the top flange 5, and when the detent hook has reached the detent opening 17 the pin 14 will tilt the entire connecting member 7 so that the detent hook 16 enters the detent opening 17 and the connecting member 7 assumes its drawer-releasing second angular position, which is shown in FIG. 3 and in which the pin 14 is disengaged from the nose 12 so that the pin 14 is no longer locked in the indentation 11 and the extraction of the drawer may then freely be continued. The hook-like detent projection 16 is now locked at the edge of the detent opening 17 so that the connecting member 7 and the stressed spring 15 are locked in the position shown in FIG. 3.

As the drawer is moved rearwardly, the pin 14 strikes on the nose 13 to exert on the connecting member 7 a reverse tilting moment so that the hook 16 is disengaged from the edge of the opening 17 and again bears on the undersurface of the top flange 5, the detent opening 11 and the pin 14 are again in the relative position shown in FIG. 1, and the connecting member 7 is in its first angular position for a movement along the guide housing 1. Via the connecting member 7 and the pin 14 locked in the indentation 11 the spring 15 will then urge the drawer to its fully retracted position.

I claim:

1. In a device for assisting retraction of a drawer, which comprises two side walls and adjacent to said side walls is in guiding contact with respective drawer-guiding corpus rails and carries respective coupling elements, which retraction-assisting device comprises two guide housings, which are fixed to respective ones of said corpus rails and each of which has forward and rear ends and comprises laterally spaced apart first and second longitudinally extending guide flanges, which constitute linear guides, and a connecting member, which extends between said guide flanges, has a rear end and a forward end pivotally connected to a spring and comprises on one side a coupling portion, which laterally protrudes from said guide housing and has outside said guide housing an indentation adapted to receive one of said coupling elements, said connecting member assumes in said guide housing a drawer-coupling first angular position, in which said connecting member with said coupling element received in said indentation is movable toward said forward end of said housing to stress said spring, said connecting member is arranged to assume in said guide housing adjacent to its forward end under the stress of said spring a drawer-releasing second angular position, in which said coupling element is disengageable from said coupling portion to release said drawer and is also adapted to re-engage said coupling portion in said indentation to return said connecting member to said first angular position so that said drawer is then coupled to said connecting member, whereafter said stressed spring is adapted to urge said connecting member with said coupling element engaging said coupling portion in said indentation toward said rear end of said guide housing, the improvement residing in that said first guide flange extends continuously substantially from said rear end to said forward end of said guide housing, said coupling portion protrudes from said guide housing beyond said first guide flange, said connecting member has on a side facing said second guide flange a detent projection, and said second guide flange defines adjacent to said forward end of said guide housing a detent receptacle for receiving said detent projection to permit said stressed spring to move said connecting member adjacent to said forward end of said housing to said second angular position.

2. The improvement set forth in claim 1, wherein said retraction-assisting device is adapted to be used with a drawer in which each of said coupling elements consists of a pin.

3. The improvement set forth in claim 1, wherein each of said detent projections consists of a hook.

4. The improvement set forth in claim 1, wherein said second guide flange of each of said guide housings has an opening, which constitutes said detent receptacle.

5. The improvement set forth in claim 1, where said second guide flange of each of said guide housings has in an inside surface, thereof a recess, which constitutes said detent receptacle.

6. The improvement set forth in claim 1, wherein said detent projection is arranged to be in sliding contact with said second guide flange when said connecting member is in said first angular position and said connecting member has a first guiding surface, which is arranged to be in sliding contact with said first guide flange when said connecting member is in said first angular position, and said connecting member has a second guiding surface, which faces said second guide flange and is arranged to engage said second guide flange when said connecting member is in said second annular position.

7. The improvement set forth in claim 1, wherein said detent projection is forwardly spaced from said indentation.

8. The improvement set forth in claim 1, wherein said second guide flange is wider than said first guide flange.

* * * * *